US009539159B2

(12) United States Patent
Lischinski et al.

(10) Patent No.: US 9,539,159 B2
(45) Date of Patent: Jan. 10, 2017

(54) THERMOTHERAPY DEVICE

(71) Applicant: DRÄGER MEDICAL GMBH, Lübeck (DE)

(72) Inventors: Robert Lischinski, Einhaus (DE); Markus Kater, Hamburg (DE)

(73) Assignee: Drägerwerk AG & Co. KGaA, Lübeck (DE)

( * ) Notice: Subject to any disclaimer, the term of this patent is extended or adjusted under 35 U.S.C. 154(b) by 92 days.

(21) Appl. No.: 14/415,824

(22) PCT Filed: Jul. 3, 2013

(86) PCT No.: PCT/EP2013/064004
§ 371 (c)(1),
(2) Date: Jan. 20, 2015

(87) PCT Pub. No.: WO2014/012791
PCT Pub. Date: Jan. 23, 2014

(65) Prior Publication Data

US 2015/0164723 A1 Jun. 18, 2015

(30) Foreign Application Priority Data

Jul. 18, 2012 (DE) ..... 10 2012 212 572

(51) Int. Cl.
*A61G 11/00* (2006.01)

(52) U.S. Cl.
CPC ..... *A61G 11/002* (2013.01); *A61G 11/00* (2013.01); *A61G 11/006* (2013.01); *A61G 2210/90* (2013.01)

(58) Field of Classification Search
CPC ..... A61G 11/00; A61G 11/05; A61G 11/006
USPC ..... 600/21–22
See application file for complete search history.

(56) References Cited

U.S. PATENT DOCUMENTS

| | | | |
|---|---|---|---|
| 2,600,240 | A | 6/1952 | Grieb |
| 3,076,451 | A | 2/1963 | Stoner |
| 3,335,713 | A | 8/1967 | Grosholz et al. |
| 4,617,912 | A | 10/1986 | Beer et al. |
| 5,308,310 | A | 5/1994 | Roff et al. |

(Continued)

FOREIGN PATENT DOCUMENTS

| | | | |
|---|---|---|---|
| CH | 664 892 | A5 | 4/1988 |
| CN | 2649111 | Y | 10/2004 |

(Continued)

*Primary Examiner* — John Lacyk
(74) *Attorney, Agent, or Firm* — McGlew and Tuttle, P.C.

(57) ABSTRACT

A thermotherapy device includes a therapy unit (2) with housing having sidewalls surrounding a lying surface, a support device (8) that supports the therapy unit (2) and a heating device (7) for heating an area of the surrounded lying surface. The housing of the therapy unit (2) is open at the bottom. The support device (8) has a base wall arrangement (10) fixedly connected thereto which completes and locks the housing open at the bottom of the therapy unit to form a housing closed off at the bottom in the closed position of the therapy unit. The therapy unit (2) is mounted pivotably on one side in relation the base wall arrangement (10). The therapy unit (2) is pivotable between the closed position with the housing closed and an open position remote from the base wall arrangement, in which position the components in an interior of the housing are accessible.

20 Claims, 8 Drawing Sheets

(56) References Cited

U.S. PATENT DOCUMENTS

| | | | | |
|---|---|---|---|---|
| 8,337,384 | B2 * | 12/2012 | Honma | A61G 11/00 600/22 |
| 2011/0046433 | A1 | 2/2011 | Khodak | |

FOREIGN PATENT DOCUMENTS

| | | | |
|---|---|---|---|
| CN | 101240871 | A | 8/2008 |
| EP | 1 060 727 | A1 | 12/2000 |
| EP | 1 231 883 | B1 | 9/2008 |
| WO | 2012/165998 | A1 | 12/2012 |

* cited by examiner

THERMOTHERAPY DEVICE

CROSS REFERENCE TO RELATED APPLICATIONS

This application is a U.S. National Phase Application of International Application PCTEP2013/064004 filed Jul. 3, 2013 and claims the benefit of priority under 35 U.S.C. §119 of German Patent Application DE 10 2012 212 572.8 filed Jul. 18, 2012, the entire contents of which are incorporated herein by reference.

FIELD OF THE INVENTION

The present invention pertains to a thermotherapy device with a therapy unit with a reclining surface surrounded by side walls and with a housing; with a carrier device, which carries the therapy unit; and with a heating device for heating the therapy unit in the area of the surrounded reclining surface.

BACKGROUND OF THE INVENTION

Such a thermotherapy device is known, for example, from EP 1 060 727 A1. Such thermotherapy devices are used, for example, as incubators for the nursing care for premature infants. The therapy unit may also be provided with a hood, which is closed in case of closed nursing care and is open in case of open nursing care. The heating device may be a radiant heater in case of an open therapy unit and a convection heater in case of a therapy unit closed with a hood.

Various maintenance procedures need to be performed during the service life of a thermotherapy device. Parts subject to wear are to be replaced regularly or defective components are to be replaced in case of failure. The device cannot be used by the user during the maintenance procedures. This means for the user, for example, the hospital, that the thermotherapy device is not available during the maintenance time even in urgent cases. Depending on the scope of the maintenance procedures and the duration of the maintenance procedure, this may lead to long down times. Not only does this result in costs for the hospital, but it leads to irregularities that cannot be planned for both the staff and the premature infant requiring the thermotherapy device. To ensure the nursing care of premature infants, a larger fleet of thermotherapy devices must be maintained in order to have a sufficient number of ready-to-use devices available even in case of maintenance procedures being performed on individual thermotherapy devices. To keep these inconveniences as low as possible, the devices should become suitable for use again as quickly as possible in case of maintenance or repair. All electric components, parts, cables, etc., must be able to be reached and replaced quickly and reliably for this purpose. Since the service technician performs these maintenance or repair procedures on site on the client's premises, he has to be able to perform the activities in a simple manner, without great effort and in a reliable manner. Very good accessibility to all components affected, which are located in the interior of the housing, is a prerequisite for the ability to perform the maintenance or repair procedures with replacement of one or more components reliably and quickly.

For example, flaps are provided on the housing of the therapy unit of the thermotherapy device at the bottom in conventional thermotherapy devices. These flaps can be opened, for example, by folding the flaps away downwardly, as is shown in FIG. 8, after which the service technician has access from the bottom to the components located in the interior of the housing of the thermotherapy device or to components on the inside of the folded-up lower flap. Prior-art thermotherapy devices, which are similar, in principle, and are known from the state of the art, are shown in FIGS. 6 and 7, where a bottom 22 of the housing is detachable in FIG. 6. The base wall 24 is designed in the device shown in FIG. 7 as a pivotable flap, and after this flap is pivoted away, components located in the interior of the housing of the thermotherapy device is accessible from the bottom. An area of the base wall can likewise be folded up in the device shown in FIG. 8, after which there is access to both the interior of the housing and components located on the inner side of the opened flap.

Accessibility for the service technician for maintenance and repair purposes is greatly limited in all these embodiments, because the service technician must bend under the device and then must search for access from below into the interior of the housing or to components located on the inner side of an opened flap. This is ergonomically highly unfavorable and difficult, on the one hand, and time-consuming, on the other hand, which leads to the problems of long down times of thermotherapy devices, which were addressed above. It is also a drawback that errors can occur more readily during maintenance or repair procedures because access to the components in question is difficult for the service technician, for example, when a component that is to be replaced is not inserted correctly because of the difficult accessibility in the interior of the housing, so that it will not function as desired during use.

SUMMARY OF THE INVENTION

An object of the present invention is to design a thermotherapy device such that repair and maintenance procedures, which are to be performed on components located in the interior of the thermotherapy device, can be performed more quickly and reliably.

According to the invention, a thermotherapy device is provided comprising a therapy unit with a reclining surface surrounded by side walls and with a housing. A carrier device (support structure) is provided that carries the therapy unit. A heating device is provided for heating the therapy unit in an area of the surrounded reclining surface. The housing of the therapy unit is open at the bottom. The carrier device is rigidly connected to a base wall arrangement. The base wall arrangement completes and closes off the housing of the therapy unit, which housing is open at the bottom, in a closed position of the therapy unit to form a housing that is closed at the bottom. The therapy unit is mounted on one side pivotably in relation to the base wall arrangement. The therapy unit can be pivoted between the closed position, in which the housing is closed, and an open position away from the base wall arrangement, in which components located in the interior of the housing are accessible.

Provisions are made according to the present invention for the housing of the therapy unit to be open at the bottom and for the carrier device (support device) to have the base wall arrangement rigidly connected thereto. The base wall arrangement forms a part of the housing of the therapy unit and closes off the housing of the therapy unit. The housing opens at the bottom and in a closed position of the therapy unit the housing is a closed housing. The base wall arrangement forms a part of the walls of the closed housing in the lower area thereof in the closed position. In other words, the housing is divided into an upper part, which is open at the bottom and which comprises the laterally surrounded reclining surface, and a lower part, which parts form a housing that is closed at the bottom in the closed state.

The therapy unit is mounted pivotably on one side in relation to the base wall arrangement, so that the therapy unit can be pivoted between a closed position with the housing closed and an open position away from the base wall arrangement, in which components located in the interior of the housing are accessible.

This embodiment has the advantage that the service technician can open the housing quickly by pivoting the therapy unit up. Further, the service technician has good access in the opened state to the interior of the housing, for which the service technician does not have to bend under the device, as in the state of the art. For example, components of a convection heater, which is located in the interior of the housing and is used for heating in case of closed nursing care when the reclining surface is covered from the top with a hood, can thus be accessible.

A fixing device is designed to detachably fix the therapy unit in the pivoted-up position with the housing open. The fixing device is advantageously provided in an advantageous embodiment.

A driving device (drive), which drives the pivoting motion of the therapy unit into the open position, is provided in a preferred embodiment. The driving device is a pneumatic or electric driving device in preferred embodiments. The service technician must actuate a switch in this case in order to activate thereby the driving device, which will then pivot the therapy unit into the open position.

A supporting device, which support a manually effected pivoting of the therapy unit into the open position, may be provided in alternative embodiments. The supporting device may have a spring, especially a compression spring or a gas spring.

Due to the embodiment according to the present invention, optimal access can be achieved to the components located in the interior of the thermotherapy device without much trouble. The therapy unit and the base wall arrangement form a closed housing in the closed state, but this housing is divided into an upper part (therapy unit) and a lower part (base wall arrangement). The housing is opened by pivoting away the entire therapy unit, because the upper housing part is pivoted away. All the components that are located in the interior of the upper housing part (therapy unit) and of the lower housing part (base wall arrangement) are readily visible and freely accessible after pivoting up the therapy unit.

The present invention will be described below on the basis of exemplary embodiments shown in the drawings The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
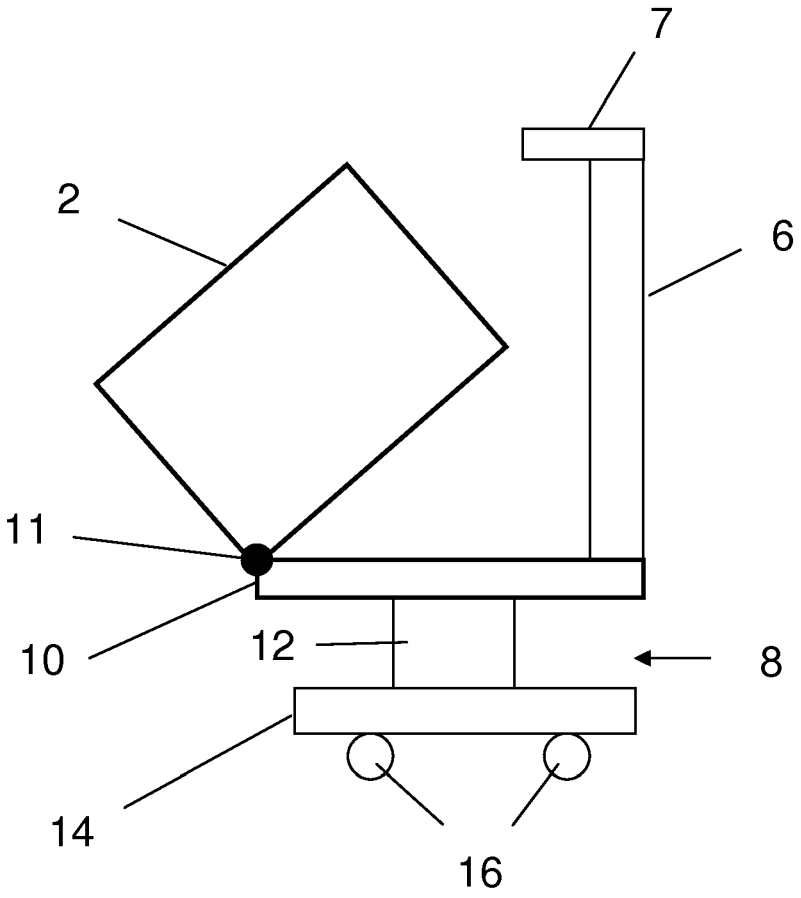
FIG. 1 is a schematic side view of a thermotherapy device with the therapy unit pivoted up.
Figure 2:
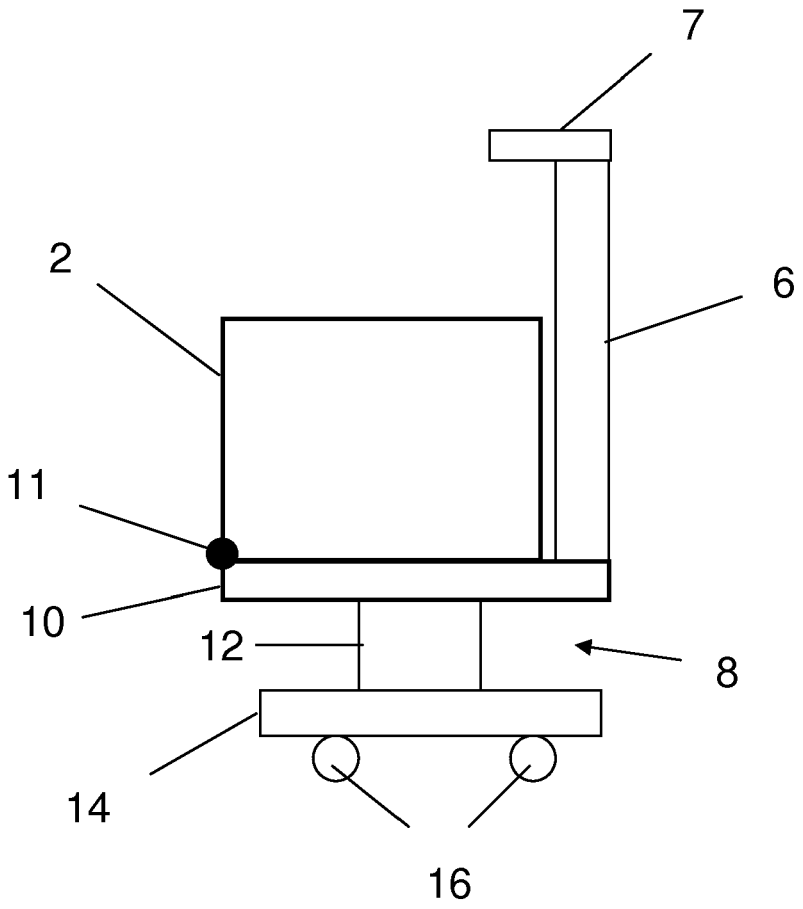
FIG. 2 is a schematic side view of the thermotherapy device from FIG. 1 with the housing closed.

Referring to the drawings, FIGS. 1 and 2 show schematic side views of a thermotherapy device with the therapy unit 2 in the partially pivoted-up position and in the closed position. The thermotherapy device has a carrier device 8, which carries, among other things, the therapy unit 2. The carrier device 8 comprises a carrier chassis 14, which is provided with rollers 16 and carries a carrier column 12. The carrier column 12 carries, in turn, a base wall arrangement 10, which forms a part of the housing of the thermotherapy device. In the closed position shown in FIG. 2, the outer walls of the therapy unit 2 and the walls of the base wall arrangement 10 together form the housing of the thermotherapy device, which latter surrounds the interior space of said housing.

The thermotherapy device from FIGS. 1 and 2 has, further, a column 6, which is mounted on the base wall arrangement 10 and carries a heating device 7 in the form of a radiant heater.

The base wall arrangement 10 and the therapy unit 2 are connected with one another via a pivot connection 11. The pivot connection 11 may have one or more hinges, which together define a pivot axis about which the therapy unit 2 can be pivoted in relation to the base wall arrangement 10. Furthermore, a closing device may be provided, with which the therapy unit 2 can be fixed in the closed position at the carrier wall arrangement 10. The closing device may be actuated manually in order to bring it into an open position, in which the therapy unit 2 can be pivoted away from the base wall arrangement 10, or into a closed position, in which the housing formed from the outer walls of the therapy unit 2 and the base wall arrangement 10 is held in the closed position.

Figure 3:
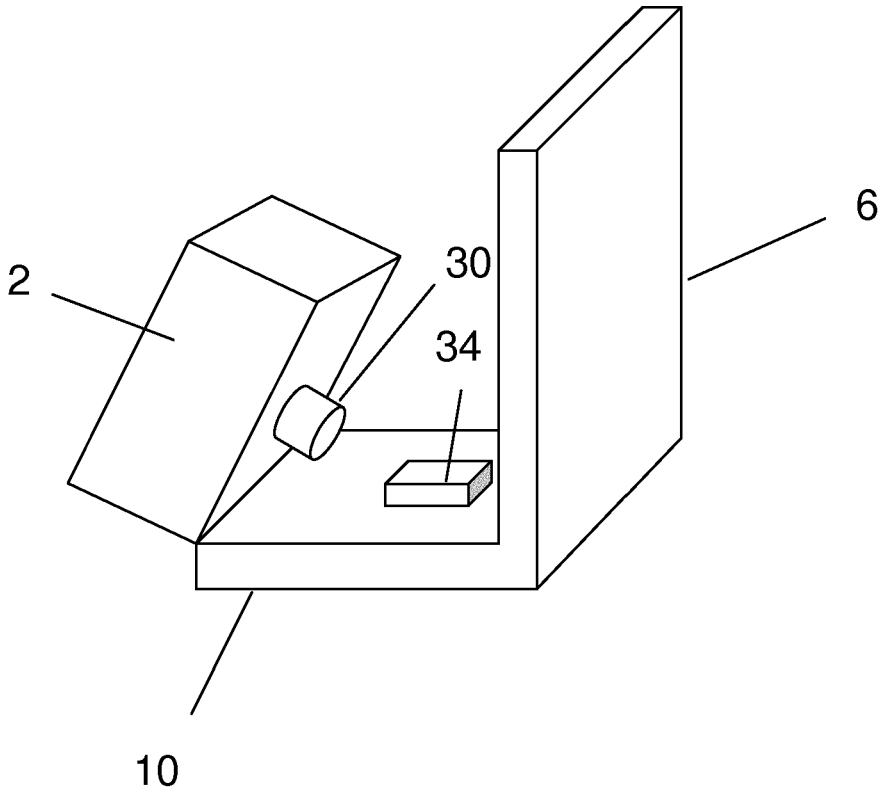
FIG. 3 is a perspective partial view of a thermotherapy device with the therapy unit pivoted away.

FIG. 3 shows a schematic partial view of a thermotherapy device with the therapy unit 2 pivoted up. After opening the closing device and pivoting away the therapy unit 2, the service technician has access to the interior of the therapy unit 2 and the base wall arrangement 10. FIG. 3 schematically shows a component 30 in the interior of the therapy unit 2 and a component 34 in the interior of the base wall arrangement 10, to which components the service technician has access in this open position in a simple manner in order to replace them or to process them in another way.

Figure 4:
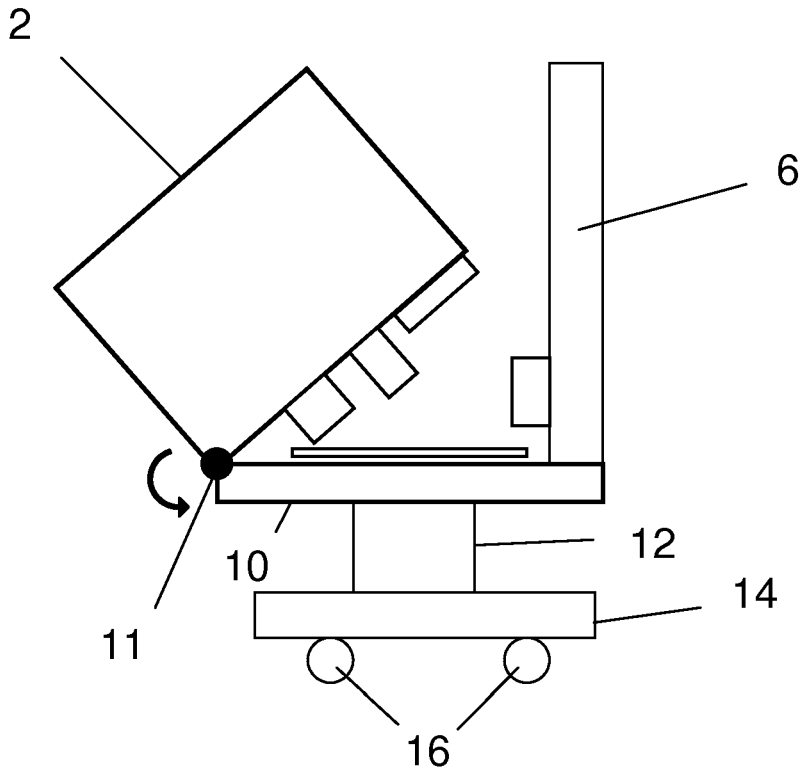
FIG. 4 is a schematic side view of a thermotherapy device with the therapy unit pivoted up.

FIG. 4 shows a schematic side view of a thermotherapy device with the therapy unit 2 opened. A plurality of components 30 from the interior of the therapy unit 2, which are readily accessible for the service technician with the therapy unit 2 pivoted away, are indicated here.

Figure 5:
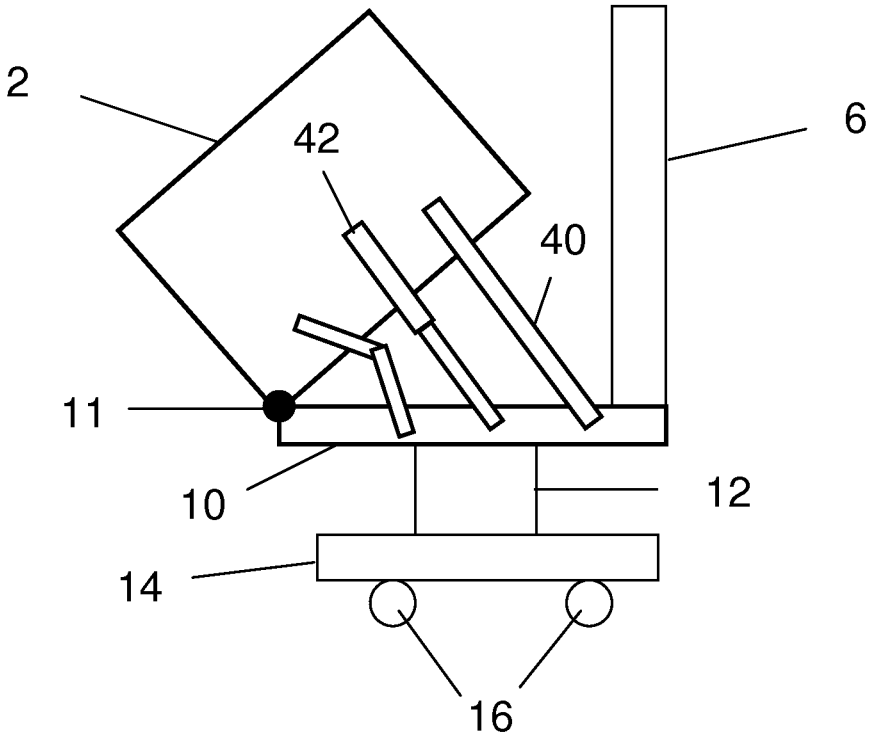
FIG. 5 is a schematic side view of a thermotherapy device with the therapy unit pivoted up.
Figure 6:
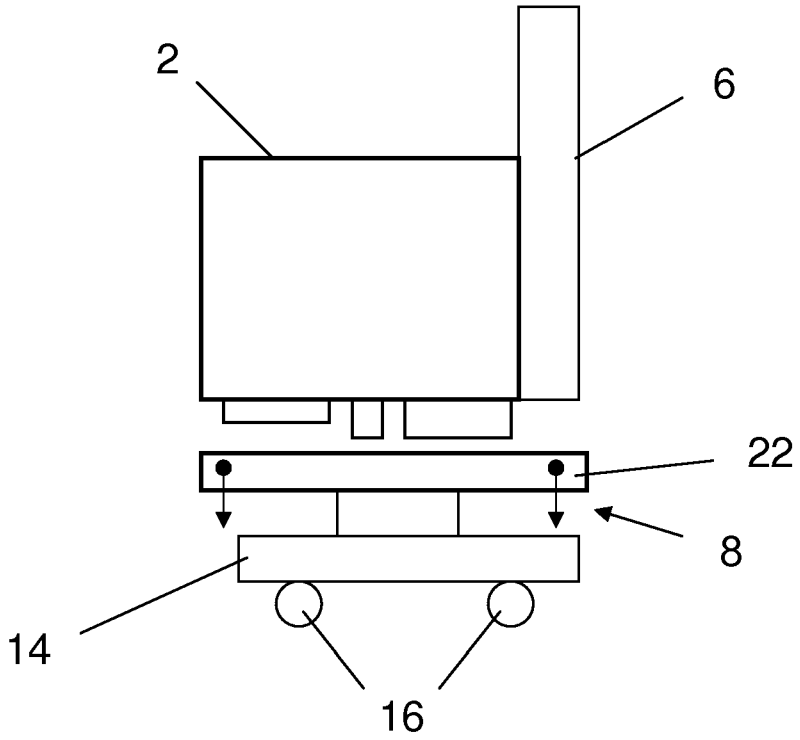
FIG. 6 is a schematic side view of thermotherapy device from the state of the art.
Figure 7:
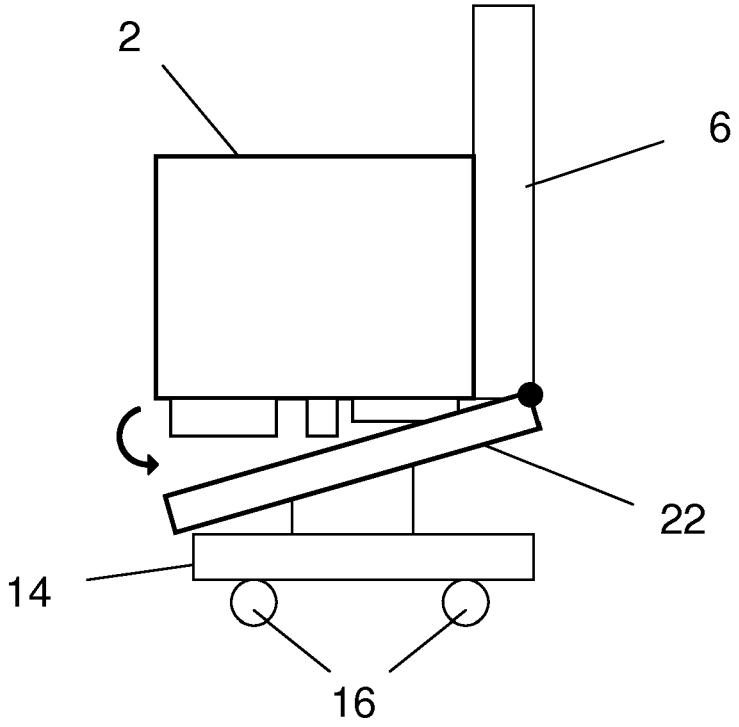
FIG. 7 is a schematic side view of thermotherapy device from the state of the art.
Figure 8:
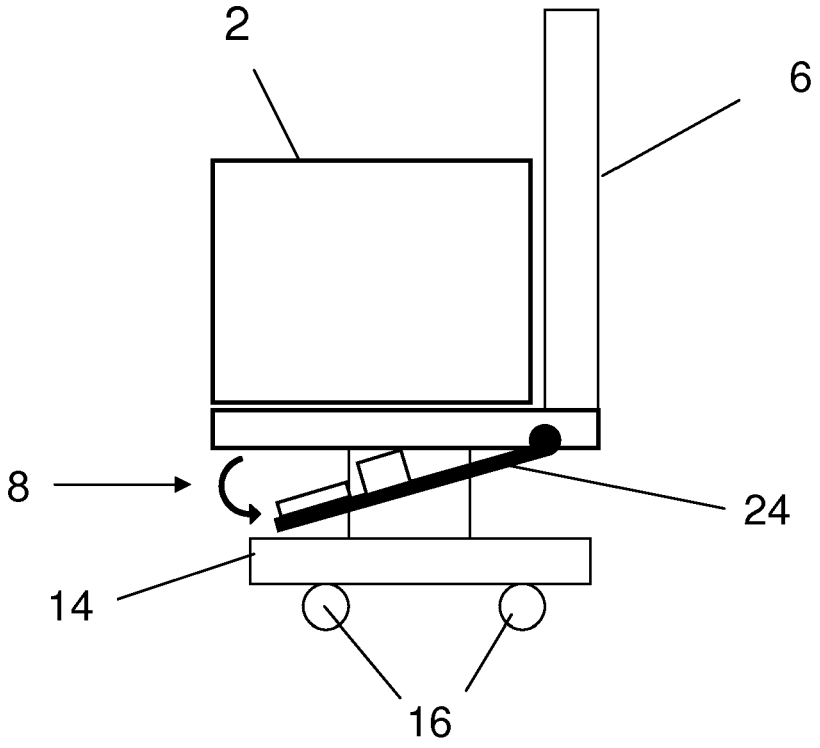
FIG. 8 is a schematic side view of thermotherapy device from the state of the art.

FIG. 5 shows a schematic side view of a thermotherapy device with the therapy unit 2 pivoted up. Further, a support bar 40 is shown here, with which the therapy unit 2 can be fixed in the open position. Further, a gas spring 42 is shown, which makes it easier for the service technician to pivot the therapy unit 2 up.

While specific embodiments of the invention have been shown and described in detail to illustrate the application of the principles of the invention, it will be understood that the invention may be embodied otherwise without departing from such principles.

The invention claimed is:

1. A thermotherapy device comprising:

a therapy unit with a reclining surface surrounded by side walls and with a housing, a carrier device, which carries the therapy unit; and a heating device for heating the therapy unit in the area of the surrounded reclining surface, wherein:

the housing of the therapy unit is open at the bottom;

a base wall arrangement is rigidly connected to the carrier device;

the base wall arrangement completes and closes off the housing of the therapy unit, which housing is open at the bottom, in a closed position of the therapy unit to form a housing that is closed at the bottom;

the therapy unit is mounted on one side pivotably in relation to the base wall arrangement; and the therapy unit can be pivoted between the closed position, in which the housing is closed, and an open position, with the housing, open at the bottom, and with the reclining surface, surrounded by side walls, pivoted away from the base wall arrangement, in which components located in the interior of the housing are accessible.

2. A thermotherapy device in accordance with claim 1, further comprising a fixing device detachably fixing the therapy unit in the open position with the housing open.

3. A thermotherapy device in accordance with claim 1, further comprising a driving device driving the pivoting motion of the therapy unit into the open position.

4. A thermotherapy device in accordance with claim 3, wherein the driving device is a pneumatic or electric driving device.

5. A thermotherapy device in accordance with claim 1, further comprising a supporting device supporting the manually effected pivoting of the therapy unit into the open position.

6. A thermotherapy device in accordance with claim 5, wherein the supporting device has a spring or a gas spring.

7. A thermotherapy device comprising:

a carrier device;

a therapy unit comprising:

a reclining surface surrounded by side walls; and a housing connected to the reclining surface and defining an interior space, below the reclining surface, with an open bottom;

a base wall arrangement completing and closing off the therapy unit housing interior space, the base wall arrangement being rigidly connected to the carrier device; and a therapy unit component disposed in the interior space, the therapy unit being pivotably mounted to the base wall arrangement whereby the therapy unit is pivoted between a closed position, in which the housing is closed, and a the pivoted-up open position, in which the therapy unit reclining surface and housing are pivoted relative to the base wall arrangement and the therapy unit component located in the interior space of the therapy unit housing is accessible; and a heating device for heating the therapy unit in the area of the surrounded reclining surface.

8. A thermotherapy device in accordance with claim 7, further comprising a fixing device detachably fixing the therapy unit in the therapy unit housing open position.

9. A thermotherapy device in accordance with claim 7, further comprising a drive acting on the therapy unit to pivot the therapy unit into the therapy unit housing open position.

10. A thermotherapy device in accordance with claim 9, wherein the drive is a pneumatic or electric drive device.

11. A thermotherapy device in accordance with claim 7, further comprising a supporting device supporting a manually effected pivoting of the therapy unit into the open position.

12. A thermotherapy device in accordance with claim 7, wherein the supporting device comprises a spring or a gas spring.

13. A thermotherapy device in accordance with claim 7, further comprising a fixing device detachably fixing the therapy unit in the pivoted-up position with the housing open.

14. A thermotherapy device comprising:

a therapy unit comprising a reclining surface, side walls, the reclining surface being surrounded by the side walls, and a housing part that is fixed to the reclining surface and is open at a therapy unit bottom;

a carrier device;

a heating device for heating a therapy unit area surrounded by the side walls;

a base wall arrangement fixed to the carrier device, the base wall arrangement cooperating with the housing part of the therapy unit to form an interior therapy unit component space which is enclosed in a closed position of the therapy unit; and a pivot connection pivotably connecting the housing part of the therapy unit to the base wall arrangement, the therapy unit being pivotable between the closed position and an open position, with the housing part, open at the bottom, and with the reclining surface, surrounded by the side walls, pivoted away from the base wall arrangement whereby the component space is accessible and not enclosed.

15. A thermotherapy device in accordance with claim 14, further comprising a fixing device detachably fixing the therapy unit in the open position with the housing open.

16. A thermotherapy device in accordance with claim 14, further comprising a driving device driving the pivoting motion of the therapy unit into the open position, wherein the driving device is a pneumatic or electric driving device.

17. A thermotherapy device in accordance with claim 14, further comprising a supporting device supporting the manually effected pivoting of the therapy unit into the open position.

18. A thermotherapy device in accordance with claim 17, wherein the supporting device has a spring or a gas spring.

19. A thermotherapy device in accordance with claim 14, further comprising a therapy unit component disposed in the interior space and fixed to the housing part to pivot, with the housing part and with the reclining surface, surrounded by the side walls, away from the base wall arrangement whereby the component is accessible and not enclosed.

20. A thermotherapy device in accordance with claim 14, further comprising a therapy unit component disposed in the interior space and fixed to the base wall arrangement, whereby upon pivoting the housing part and the reclining surface, surrounded by the side walls, away from the base wall arrangement, the component is accessible and not enclosed.

* * * * *